US005087215A

United States Patent [19]

Simuni

[11] Patent Number: 5,087,215

[45] Date of Patent: Feb. 11, 1992

[54] OCEAN-GOING VESSEL AND METHOD FOR INCREASING THE SPEED

[76] Inventor: Leonid Simuni, 1056 Neilson St., Apt. 6 A, Far Rockaway, N.Y. 11691

[21] Appl. No.: 563,072

[22] Filed: Mar. 8, 1990

[51] Int. Cl.[5] ..... B63H 21/20

[52] U.S. Cl. ..... 440/6; 60/202; 440/67; 440/113

[58] Field of Search ..... 440/6, 49, 113, 67, 440/202; 310/11; 416/241 A; 60/202; 244/62

[56] References Cited

U.S. PATENT DOCUMENTS

| | | | |
|---|---|---|---|
| 2,230,273 | 2/1941 | Smith | 440/49 X |
| 2,543,253 | 2/1951 | Napoli | 440/49 X |
| 2,997,013 | 8/1961 | Rice | 440/38 |
| 3,322,374 | 5/1967 | King, Jr. | 244/62 |
| 3,662,554 | 5/1972 | Broqueville | 244/62 |
| 3,678,306 | 7/1972 | Garnier et al. | 60/202 X |
| 3,708,251 | 1/1973 | Pierro | 440/6 X |
| 3,744,931 | 7/1973 | Cavanagh | 416/244 A X |

FOREIGN PATENT DOCUMENTS

| | | | |
|---|---|---|---|
| 71794 | 4/1987 | Japan | 440/6 |
| 247196 | 10/1988 | Japan | 440/113 |
| 182193 | 7/1989 | Japan | 440/6 |
| 2217117 | 10/1989 | United Kingdom | 440/6 |

OTHER PUBLICATIONS

Introducing Magnetohydro Dynamics by Arthur Kandrowitz, "Astronautics", Oct. 1958.

"A Place for Superconducting D.C. Machines in Marine Propulsion", Appleton et al., 1978 IPC Business Press.

*Primary Examiner*—Sherman Basinger

[57] ABSTRACT

An ocean-going vessel comprises a stern power plant and side propulsion units attached to the starboard side and to the port side of the ocean-going vessel. Each side propulsion unit comprises two combined propulsion systems having tubular propellers and magnetohydrodynamic drives. The front and rear combined propulsion systems or the starboard side and the port side are united by a tube. Side propulsion units are adapted to provide additional thrust and maneuverability to the ocean-going vessel. Side propulsion units are adapted to provide braking actions by reversing combined propulsion systems.

3 Claims, 1 Drawing Sheet

OCEAN-GOING VESSEL AND METHOD FOR INCREASING THE SPEED

BACKGROUND OF THE INVENTION

1. Field of the Invention

This invention relates to a combined propulsion system having a magnetohydrodynamic drive (MHDD) for use with a marine vessel. The power plant of a marine vessel consists of thermal engines, a reduction gear and propelling means arranged at the stern. The speed of existing marine vessels depends upon the power of the propulsion units and the number of propellers used. The power of the propulsion units is limited by gabarits of the marine vessel. The conventional arrangement of the propellers at the stern of the vessel limits the number of propellers that can be used. Also the speed of rotation of the propellers is limited by cavitation.

The present invention provides a combined propulsion system for increasing the speed and maneuverability of the marine vessel.

2. Prior Art

Attempts have been made in the past to employ the magnetohydrodynamic drive (MHDD) as a propulsion system. The concept of MHDD is illustrated in U.S. Pat. No. 2,997,013, to W. A. Rice, issued on Aug. 22, 1961. According to the law of Physics an interaction of the magnetic field and electric current in an ionic media causes a thrust which is directly proportional to the magnetic field strength and the current density. Both Japan and the United States are making research efforts in developing MHDD. An early design is expected to be capable of only 8 knots, and with low efficiency. Attempts have been made to increase the efficiency of MHDD, for example, in GB Patent 2,217,117 A. In Japan a ship has been designed with a nuclear power plant and further comprising MHDD. Development of high speed MHDD depends on the development of extremely powerful magnets. A drawback is that increasing the magnetic field strength may have injurious effects on human organisms and would cause tremendous magnetic disturbances. It will interfere with sealife and other shipping.

Accordingly, this invention has as a main object providing a combined propulsion system having a MHDD for a vessel.

Another object is to have the combined propulsion system of such construction as to be readily adaptable for use with existing marine vessels. A further object of this invention is to adjust the combined propulsion system to marine vessels so as to improve their maneuverability.

SUMMARY OF THE INVENTION

Accordingly, it is a purpose of the present invention to develop the combined propulsion system for use with a marine vessel.

In keeping with this purpose, the combined propulsion system includes a tubular propeller and a MHDD. The combined propulsion systems are united in a side propulsion unit.

The novel features of the present invention are set forth in particular in the appended claims.

The invention itself, however, both as to its construction and its manner of operation will be best understood from the following description of a preferred embodiment which is accompanied by the following drawings illustrating the invention.

DESCRIPTION OF A PREFERRED EMBODIMENT

Figure 1:
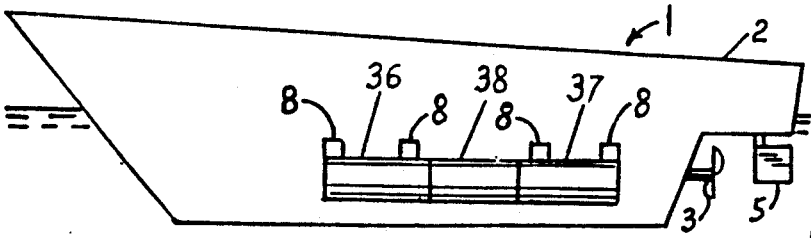
FIG. 1 is a side view of a marine vessel using the combined propulsion systems.
Figure 2:
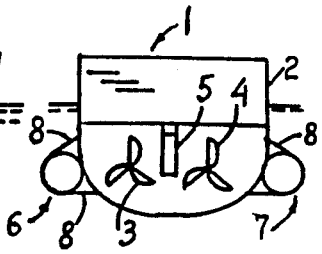
FIG. 2 is a stern view.
Figure 3:
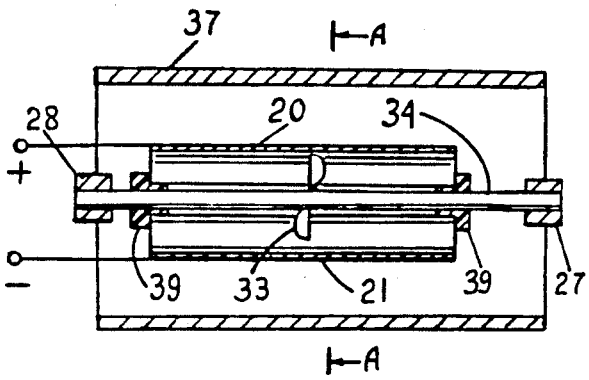
FIG. 3 is a cross-section of the tubular propeller and the MHDD.
Figure 4:
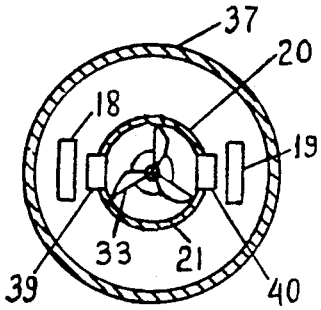
FIG. 4 is a section taken along the line A—A of FIG. 3.
Figure 5:
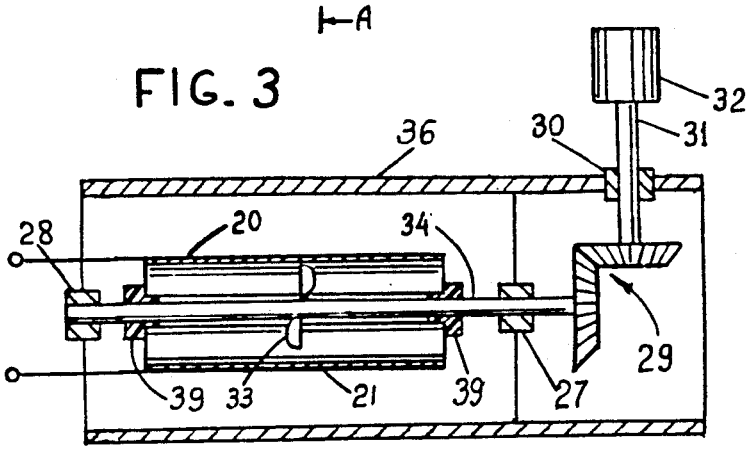
FIG. 5 is the combined propulsion system using an electric motor drive.
Figure 6:
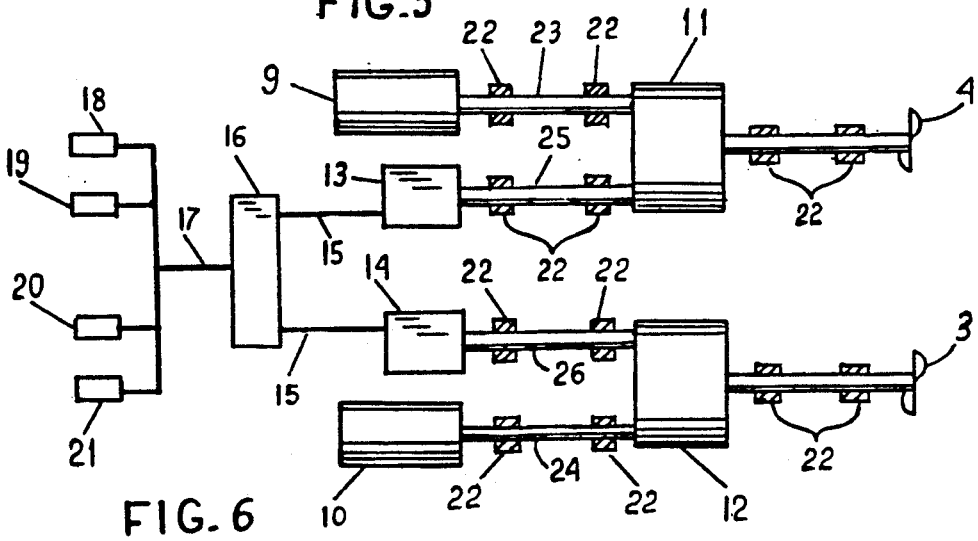
FIG. 6 is a scheme of the stern power plant of the marine vessel.

A combined propulsion system in accordance with the present invention is identified as a whole with reference numerals 36, 38, and 37. The combined propulsion system comprises a tubular propeller 33 and MHDD. A shaft 34 of the tubular propeller 33 is oriented along the longitudinal axis of the combined propulsion system. The front tube 36 has a driving motor 32 connected to the shaft 34 by means of the drive shaft 31 and the gearing 29. The shaft 34 is supported by means of bearings 27 and 28 located at each end of the tubes. The shaft 31 is supported by means of bearing 30. The driving motor 32 is an electric motor. Propeller 33 in tube 37 is shown as not being driven by a drive motor.

The MHDD comprises an electrode of positive polarity 20 and an electrode of negative polarity 21. Electrodes 20 and 21 are shaped as a circular duct having an inner diameter slightly larger than the maximum diameter of the tubular propeller 33. Two circular ducts are mounted along the longitudinal axis of the combined propulsion system so that a duct is concentric with tube 37 and a duct is concentric with tube 36. Electrodes 20 and 21 are connected to a transformer of electro-energy 16 adapted to produce the required direct electro-current. Electrodes 20 and 21 must be insulated from the tubes 36 and 37. There are insulators 39 and 40 between the electrodes 20 and 21. The MHDD comprises superconducting magnets 18 and 19 which produce the magnetic flux for interaction with the electro-current between the electrodes 20 and 21. The structure of superconducting magnets is known in the art and is disclosed, for example, in Japan Patent Document No. 62-71794 (A), issued to Masayoshi Wake on Apr. 2, 1987.

The magnetic flux of superconducting magnets 18 and 19 and a current between electrodes 20 and 21 must be oriented, by virtue of their mountings so as to produce the propulsive thrust force directed along the longitudinal axis of the combined propulsion system in accordance with the "Left Hand Rule". For example, if the magnetic flux is directed from superconducting magnet 18 to superconducting magnet 19 then the electric current must be directed from electrode 21 to the electrode 20. The combined propulsion system is adapted to summarize the propulsive thrust force produced by tubular propeller 33 and the magnetohydrodynamic propulsive force.

The combined propulsion system is adapted for introducing the sea water into the tube 36. Two combined propulsion systems are united by a tube 38 to form a side propulsion unit for use with the vessel. The rear combined propulsion unit is adapted to summarize the propulsive forces produced by both of the combined propulsion systems. The side propulsion units are adapted to be mounted to the starboard side and the port side of the marine vessel symmetrically so as to be immersed when the vessel is in use and to produce additional propulsive thrust forces directed along the longitudinal axis of the vessel. Reference numerals 6 and 7 points out side propulsion units on the port side and starboard side of the vessel respectively.

FIG. 1 shows the marine vessel having the side propulsion unit according to present invention. The vessel is identified as a whole with reference numeral 1. Propellers 3 and 4, rudder 5, the side propulsion units, the reduction gears 11 and 12, the engines 9 and 10, the electro-generators 13 and 14, and the transformer 16 are arranged along and within the hull 2. The side propulsion units are mounted to the hull 2 by means of bars 8. Engines 9 and 10 drive reductions gears 11 and 12 by shafts 23 and 24 respectively. The reduction gear 11 drives electro-generator 13 by shaft 25 and the propeller 4 by another shaft. The reduction gear 12 drives the electro-generator 14 by shaft 26 and the propeller 3 by another shaft. The shafts 23, 24, 25, 26 and the propeller shafts are supported by bearings 22. The transformer 16 is connected to electro-generators 13 and 14 by cables 15. The transformer 16 produces the direct electro current to serve electrodes 20 and 21 and superconducting magnets 18 and 19 connected to the transformer 16 by cable 17.

The above operation of the marine vessel having the side propulsion units are summarized as follows:

The engines 9 and 10 are operated for running at a low speed.

The tubular propellers 33 are operated for running at a low speed.

The engines 9 and 10 and the side propulsion units are operated to provide the maximum speed.

The side propulsion units are operated to provide various manoeuvres (various combinations are possible).

The side propulsion units are operated to provide braking actions, for example, by reversing the tubular propellers 33. The reversing of the MHDD may be produced by changing of interaction of the electro-current and magnetic flux according to the "Left Hand Rule".

I claim:

1. A side propulsion unit for providing additional thrust to a marine vessel, said system comprising:

a first tube attached to said vessel, a second tube attached to said vessel, a third tube attached to said vessel;

said second tube connecting said first and said third tubes;

a first and a second propeller, said first tube surrounding said first propeller and said third tube surrounding said second propeller, each of said propellers being mounted on a propeller shaft, each said propeller being further located inside of a circular duct, said duct comprising a first electrode, a second electrode, and a plurality of insulators connecting said electrodes;

a set of super conducting magnets, each one of said set of magnets being located outwardly of and on each side of said circular duct adjacent one of said plurality of said insulators, said super conducting magnets and said electrodes forming a magnetohydrodynamic drive;

an electric motor, said electric motor driving one of said propellers through one of said propeller shafts;

and wherein said propellers and said magnetohydrodynamic drives provide additional thrust and maneuverability to said vessel.

2. A side propulsion unit as in claim 1 wherein said vessel has a starboard side and a port side, and at least one side propulsion unit is attached to said starboard side and to said port side.

3. A side propulsion unit as in claim 1 wherein said vessel has a stern and a power plant, said power plant driving two screw propellers located at said stern of said vessel, and said power plant further driving at least one generator for providing electro current for said first and said second electrodes and said magnets.

* * * * *